US012564261B2

(12) United States Patent
Gilbert

(10) Patent No.: US 12,564,261 B2
(45) Date of Patent: Mar. 3, 2026

(54) SHELF FOR A CABINET FOR RECEIVING BOTTLES

(71) Applicant: EUROCAVE, Villeurbanne (FR)

(72) Inventor: Félix Gilbert, Lyons (FR)

(73) Assignee: EUROCAVE, Villeurbanne (FR)

( * ) Notice: Subject to any disclaimer, the term of this patent is extended or adjusted under 35 U.S.C. 154(b) by 0 days.

(21) Appl. No.: 18/822,463

(22) Filed: Sep. 2, 2024

(65) Prior Publication Data

US 2025/0072601 A1 Mar. 6, 2025

(51) Int. Cl.
*A47B 73/00* (2006.01)

(52) U.S. Cl.
CPC ..... *A47B 73/008* (2013.01); *A47B 73/006* (2013.01)

(58) Field of Classification Search
CPC ..... A47B 73/008; A47B 73/006; A47F 7/28
See application file for complete search history.

(56) References Cited

U.S. PATENT DOCUMENTS 2,384,870 A * 9/1945 Albrecht ..... A47F 7/28 312/111
6,290,074 B1 * 9/2001 Syvuk ..... A47F 7/283 D7/619.1
6,932,449 B2 * 8/2005 Collins ..... F25D 25/02 312/405.1
9,149,135 B2 * 10/2015 Dovell ..... A47F 7/281
9,414,671 B1 * 8/2016 Smith ..... A47B 73/00
11,002,480 B1 * 5/2021 El Sayed ..... F25D 25/024
D988,092 S * 6/2023 Deng ..... D7/701
11,910,921 B2 * 2/2024 Grychta ..... F21S 8/00
2012/0228252 A1 * 9/2012 Gossens ..... A47B 96/02 211/134
2016/0037917 A1 * 2/2016 Li ..... F25D 25/02 211/186

FOREIGN PATENT DOCUMENTS

CN 103245163 A * 8/2013
DE 19631372 A1 * 2/1998 ..... A47B 3/7008
EP 2784418 B1 * 1/2022 ..... F25D 25/02

* cited by examiner

*Primary Examiner* — Ko H Chan
(74) *Attorney, Agent, or Firm* — Soquel Group LLC

(57) ABSTRACT

A shelf including a row of supports supported by a frame, which is slidable is aligned along a transverse direction. Each support comprises cradles aligned parallel to the same longitudinal direction to form a column. Each cradle of one of the supports is aligned with a cradle of the other supports along the transverse direction, to form a row. Each support may individually support a bottle in a longitudinal position, where the bottle is arranged on the column of cradles, forming transverse wedges preventing the bottle from rolling. The supports may collectively support the bottle in a transverse position, where the bottle is arranged on one of the rows of cradles forming longitudinal wedges preventing the bottle from rolling.

9 Claims, 7 Drawing Sheets

SHELF FOR A CABINET FOR RECEIVING BOTTLES

CROSS-REFERENCE TO RELATED APPLICATIONS

This application is a U.S. non-provisional application claiming the benefit of French Application No. 23 09311, filed on Sep. 5, 2023, which is incorporated herein by reference in its entirety.

TECHNICAL FIELD OF THE INVENTION

The present invention relates to a shelf for a cabinet intended to accommodate bottles, and to a cabinet comprising such a shelf.

BACKGROUND OF THE INVENTION

A refrigerated cabinet is known, which includes shelves, on each of which glass bottles, in particular containing alcoholic beverages, such as wine or champagne, can be placed in order to be kept. Such a cabinet is generally refrigerated to a temperature corresponding to the temperature which would prevail in a cellar, ideal for the keeping such type of beverage. Such a cabinet usually has a glass door so that the bottles same contains are visible from the outside.

Bottles may have different shapes and sizes, depending on the capacity thereof, but also on other criteria, such as the geographical origin thereof or the type of beverage the bottles contain. For example, a bottle of Bordeaux wine has a body that is traditionally cylindrical, with a relatively short shoulder, whereas a bottle of Burgundy wine has a longer, tapered shoulder. Comparatively, a champagne bottle may have a larger diameter and a shorter body, with a longer neck, otherwise of equal capacity.

In order to be able to adapt to the shapes of the bottles, a known shelf has individual supports, each of which can accommodate only one bottle. The known shelf comprises a frame, on which each support can be clipped so that same can be added to or removed from the shelf. In addition, the frame permits a plurality of positions for each support, so that the distribution of supports on the shelf adapts to the different bottle formats. For example, if a bottle with a large diameter body is to be accommodated, the supports can be spaced further apart to provide the space required for the bottle. Such known shelf also serves to position the bottles, as desired, in a longitudinal direction or in a transverse direction. However, to arrange the bottle in a transverse direction, an adapter has to be mounted on the shelf beforehand, the adapter accommodating the holder in the transverse direction to support the bottle in the transverse direction.

Although such known shelf is generally satisfactory, the main drawbacks thereof are that the supports and the adapters can be tedious to assemble and disassemble. Furthermore, once same are disassembled, the supports and the adapters have to be stored and can be lost.

SUMMARY OF THE INVENTION

A goal of the invention is thus to propose a new shelf which, while remaining adaptable to different bottle formats, is more convenient to use, allows the bottles to be oriented along two directions, and for which no part is at risk of being lost.

To this end, the invention relates to a shelf for a cabinet intended to accommodate bottles, the shelf comprising a frame and at least one row of supports, which are supported by the frame and which are aligned along a transverse direction parallel to the frame. According to the invention, the supports of at least one row are can slide relative to the frame and relative to each other along the transverse direction. Each support of said at least one row comprises cradles, the cradles of the same support being aligned parallel to the same longitudinal direction parallel to the frame, to form a column of cradles, and each cradle of one of the supports of said at least one row being aligned with one of the cradles of the other supports of said at least one row along the transverse direction to form a row of cradles. Each support of the at least one row is configured to individually support a bottle in a longitudinal position, where the bottle is arranged on the column of cradles of said support and being oriented parallel to the longitudinal direction, the column of cradles forming transverse wedges between which the bottle, in the longitudinal position, is accommodated to prevent the bottle from rolling out of the column of cradles, along the transverse direction. The supports of the at least one row are configured to collectively support the bottle in a transverse position, where the bottle is arranged on one of the rows of cradles of said supports, being oriented parallel to the transverse direction, said row of cradles forming longitudinal wedges between which the bottle, in the transverse position, is accommodated, to prevent the bottle from rolling out of the row of cradles, along the longitudinal direction.

One idea underlying the invention is to provide that the supports can be slid relative to each other and relative to the frame, so that, when a bottle is to be placed in the longitudinal position on one of the supports, the position of the other supports of said at least one row relative to said support can be modified to adapt to the size of the bottle and possibly allow other bottles to be accommodated. Moreover, the same supports serve to position the bottles in the longitudinal position, and also in the transverse position without having to be disassembled and without the orientation thereof having to be modified. The fact that the supports are sliding to fit the bottles accommodated and are apt to accommodate the bottles in the longitudinal position and in the transverse position allows the shelf to be versatile without the need to disassemble the supports, which prevents same from being lost. Moreover, to prevent supports from being lost, it is advantageously provided that same are not removable from the frame.

The shelf is intended for accommodating bottles in that each support is apt and intended to individually support a bottle in the longitudinal position, and in that the supports are collectively apt and intended to collectively support a bottle in the transverse position. Thereof does not prevent the shelf from being used to accommodate objects other than bottles, in particular when such objects adapt to the shape of the supports. For example, each support may be configured to individually support a can, or another cylindrical or elongate object, in a longitudinal position, where the can, or other object, is arranged on the column of cradles of said support while being oriented parallel to the longitudinal direction. The can or other object is then accommodated between the transverse wedges, to prevent same from rolling out or falling out of the column of cradles. The supports of said at least one row are also apt to collectively support the can or other object in a transverse position, where the can or other object is arranged on one of the rows of cradles of said supports, being oriented parallel to the transverse direction.

The can or other object is then arranged between the longitudinal wedges, which prevent same from rolling out of the row of cradles. The objects accommodated by the shelf are preferentially beverages or other food products.

Preferably, for each column of cradles, the transverse wedges are distributed along exactly two columns of transverse wedges spaced apart and parallel to the longitudinal direction, the two columns of transverse wedges being configured to accommodate the bottle therebetween when the bottle is arranged on the column of cradles in the longitudinal position.

Preferably, for each row of cradles, the longitudinal wedges are distributed along exactly two rows of longitudinal wedges spaced apart and parallel to the transverse direction, the two rows of longitudinal wedges being configured to accommodate the bottle therebetween when the bottle is arranged on the row of cradles in the transverse position.

Preferably, each cradle comprises two longitudinal cylindrical surfaces, each longitudinal cylindrical surface connecting two of the transverse wedges of the cradle and being configured to accommodate the bottle while the bottle is in the longitudinal position.

Preferably, each cradle comprises two transverse cylindrical surfaces, each transverse cylindrical surface connecting two of the longitudinal wedges of the cradle and being configured to accommodate the bottle while the bottle is in the transverse position, the two transverse cylindrical surfaces being separated by the two longitudinal cylindrical surfaces and the two longitudinal cylindrical surfaces being separated by the two transverse cylindrical surfaces.

Preferably, each support is attached to the frame in a non-removable manner.

Preferably, each support of said at least one row comprises a first sliding end and a second sliding end which are opposite along the longitudinal direction. Preferably, for the at least one row of supports, the frame comprises a first rail and a second rail, which are parallel to the transverse direction. Preferably, each support of said at least one row can slide relative to the frame parallel to the transverse direction, in that each first sliding end is guided during sliding by the first rail, and in that each second sliding end is guided during sliding by the second rail.

Preferably, the frame comprises a first transverse stop which connects the first rail to the second rail, and a second transverse stop which connects the first rail to the second rail, said at least one row of supports being arranged between the first transverse stop and the second transverse stop parallel to the transverse direction, so that the first transverse stop and the second transverse stop limit therebetween the sliding of the supports of said at least one row with respect to the frame. Preferably, the supports of said at least one row of supports are trapped in the frame, being captive to the first rail, the second rail, the first transverse stop and the second transverse stop.

Preferably, two rows of supports are provided.

Preferably, for each support, at least three cradles are provided.

The subject matter of the invention is a cabinet, comprising: the shelf as defined hereinabove, the frame comprising a first side rail and a second side rail between which said at least one row of supports is arranged, the first side rail and the second side rail being parallel to the longitudinal direction; and an enclosure comprising a first lateral wall and a second lateral wall between which the shelf is arranged, the shelf being supported by the enclosure, in that the first lateral wall supports the first side rail and in that the second lateral wall supports the second side rail.

BRIEF DESCRIPTION OF THE DRAWINGS

The invention will be clearer upon reading the following description, given only as an example, but not limited to, and making reference to the drawings wherein.

DETAILED DESCRIPTION

Figure 1:
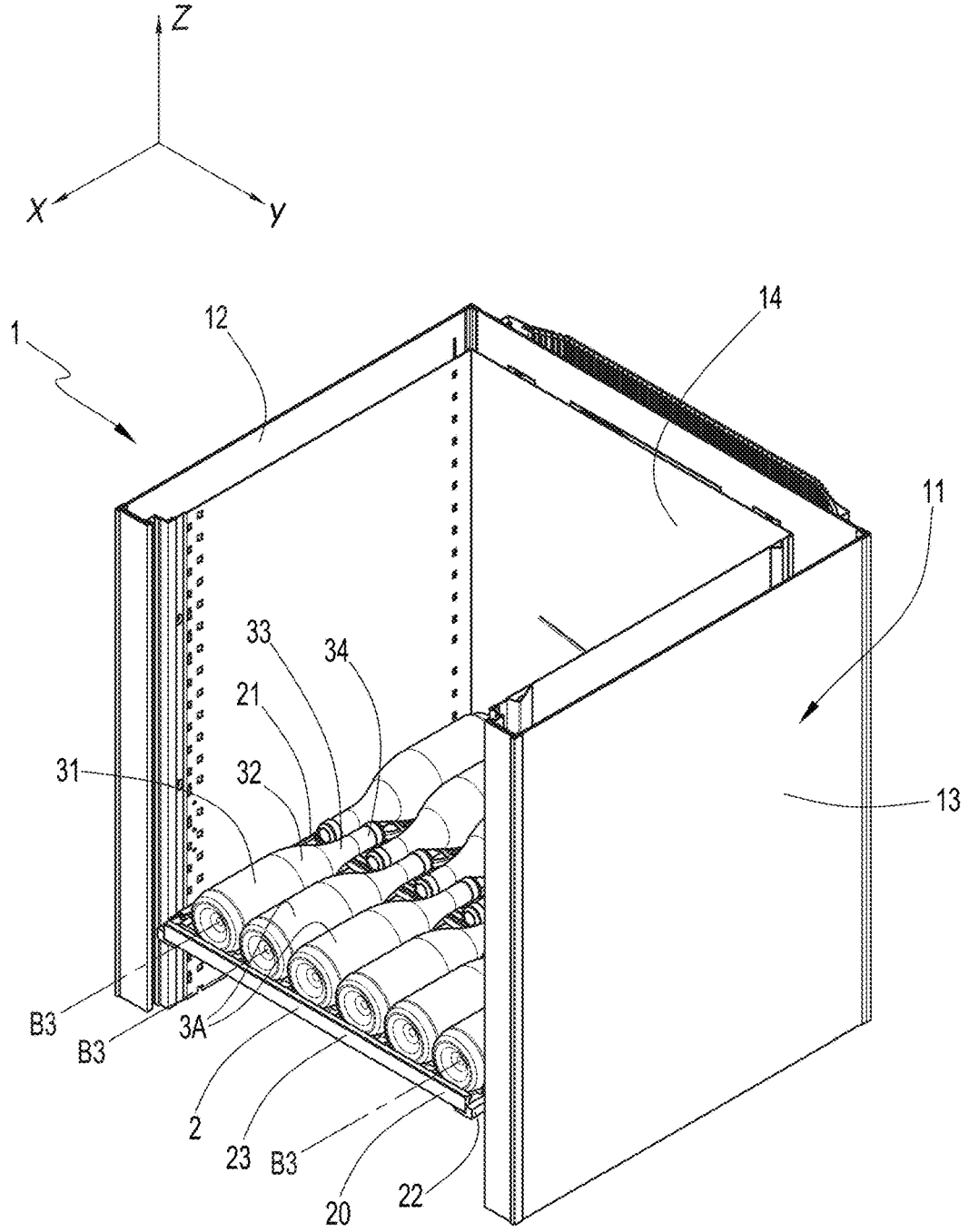
FIG. 1 is a partial perspective view of a cabinet comprising a shelf according to an embodiment of the invention, where the shelf is in a retracted position and accommodates bottles according to a first arrangement.
Figure 2:
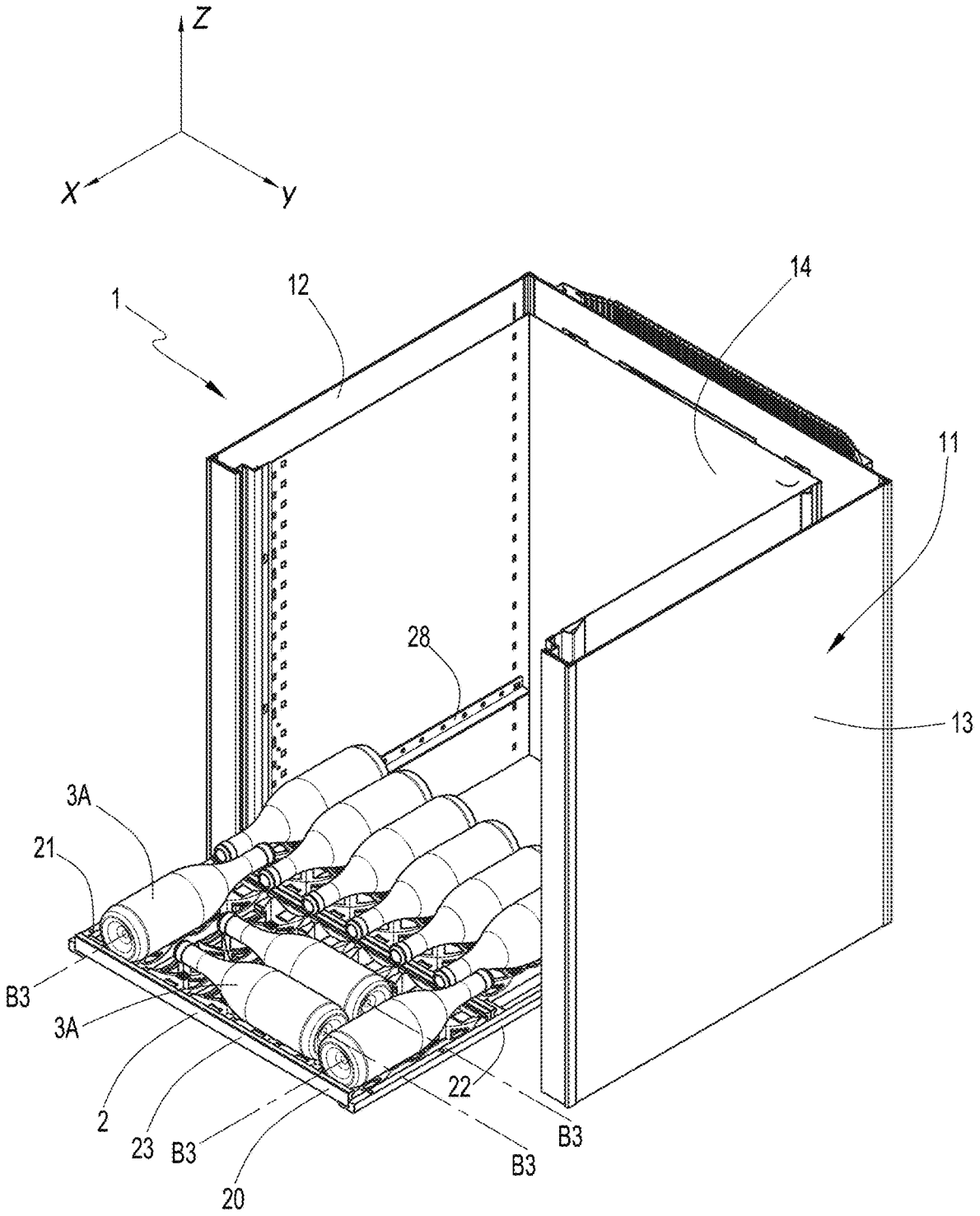
FIG. 2 is a view similar to the view of FIG. 1 where the shelf is in an extended position and accommodates bottles according to a second arrangement.

FIGS. 1 and 2 show a cabinet 1 accommodating bottles 3A and/or bottles 3B. The cabinet 1 comprises one or a plurality of shelves, including a shelf 2 shown in FIGS. 1-6. The shelf 2, forming a rack of the cabinet, is configured to support all or some of the bottles 3A and/or the bottles 3B accommodated in the cabinet 1.

A longitudinal direction X, a transverse direction Y and a height direction Z are defined, which are perpendicular to each other and fixed with respect to the shelf 2. When the shelf 2 is mounted in the cabinet 1, the directions X and Y are horizontal and the direction Z is vertical and oriented upwards.

As shown in FIGS. 1 and 2, the cabinet 1 comprises an enclosure 11, which has a general parallelepipedal shape along the directions X, Y and Z. The enclosure 11 comprises a lateral wall 12 and a lateral wall 13 spaced apart and perpendicular to the transverse direction Y. The enclosure 11 comprises a bottom wall 14 perpendicular to the direction X, connecting the walls 12 and 13. The enclosure 11 comprises a lower wall and an upper wall (not shown) which are spaced apart, perpendicular to the direction Z. The lower wall connects the walls 12, 13 and 14. The upper wall connects the walls 12, 13 and 14. The lower wall is connected to the upper wall by the walls 12, 13 and 14.

To close a front opening delimited by the walls 12 and 13 and by the lower wall and the upper wall, the enclosure 11 comprises a door, preferentially glazed (not shown). The door is perpendicular to the direction X and opposite the bottom wall 14 when the door is in a closed position. The door can be opened to insert or extract one or more of the bottles 3A and/or 3B. For this purpose, the door is preferentially swinging relative to the walls of the enclosure 11, pivoting about an axis parallel to the direction Z.

The cabinet 1 is preferentially refrigerated, i.e., comprises an integrated refrigerating machine, producing cold inside the enclosure 11 with respect to the outside, in order to maintain the inside of the enclosure at a set temperature. The refrigerating machine comprises e.g., a compressor, a condenser, an expansion valve and an evaporator, within which a refrigerant fluid circulates successively in a closed circuit. For example, the set temperature is a temperature corresponding to the temperature which would be obtained in a cellar, e.g., between 1° and 14° C. (degrees Celsius).

Overall, the shelf 2 extends perpendicularly to the direction X and the direction Y, and is much thinner along the direction Z, like a plate. The shelf 2 is arranged between the side walls 12 and 13 so as to connect same along the direction Y. The enclosure 11 supports the shelf 2 by means of the lateral walls 12 and 13. The shelf 2 is arranged between the lower wall and the upper wall, along the direction Z.

As shown in FIG. 1, when the shelf 2 is in a retracted position, the shelf 2 is arranged inside the enclosure 11, being supported by the enclosure 11. In the retracted position, the shelf 2 extends from the door to the bottom wall 14, along the opposite direction to the direction X. As shown in FIG. 2, when the door is open, the shelf 2 can be slid relative to the enclosure 11, to an extended position, where the shelf 2 is moved in the direction X relative to the retracted position thereof, the shelf 2 having passed through the front opening to extend beyond the enclosure 11 and being distant from the bottom wall 14.

Each bottle 3A and 3B contains a beverage, in particular an alcoholic beverage such as wine or champagne. Each bottle 3A and 3B comprises a body 31, a shoulder 32, a neck 33 and a throat 34 which are centered on the same axis B3 and which follow one another along the axis B. The body 31, the shoulder 32, the neck 33 and the throat 34 have e.g., a shape of revolution about the axis B3. The body 31, the shoulder 32, the neck 33 and the throat 34 are generally formed integrally from the same continuous material, e.g., glass. The throat 34 is closed by a stopper, e.g., made of cork or of a material imitating cork, so that the beverage remains enclosed by the bottle 3A or 3B.

Figure 3:
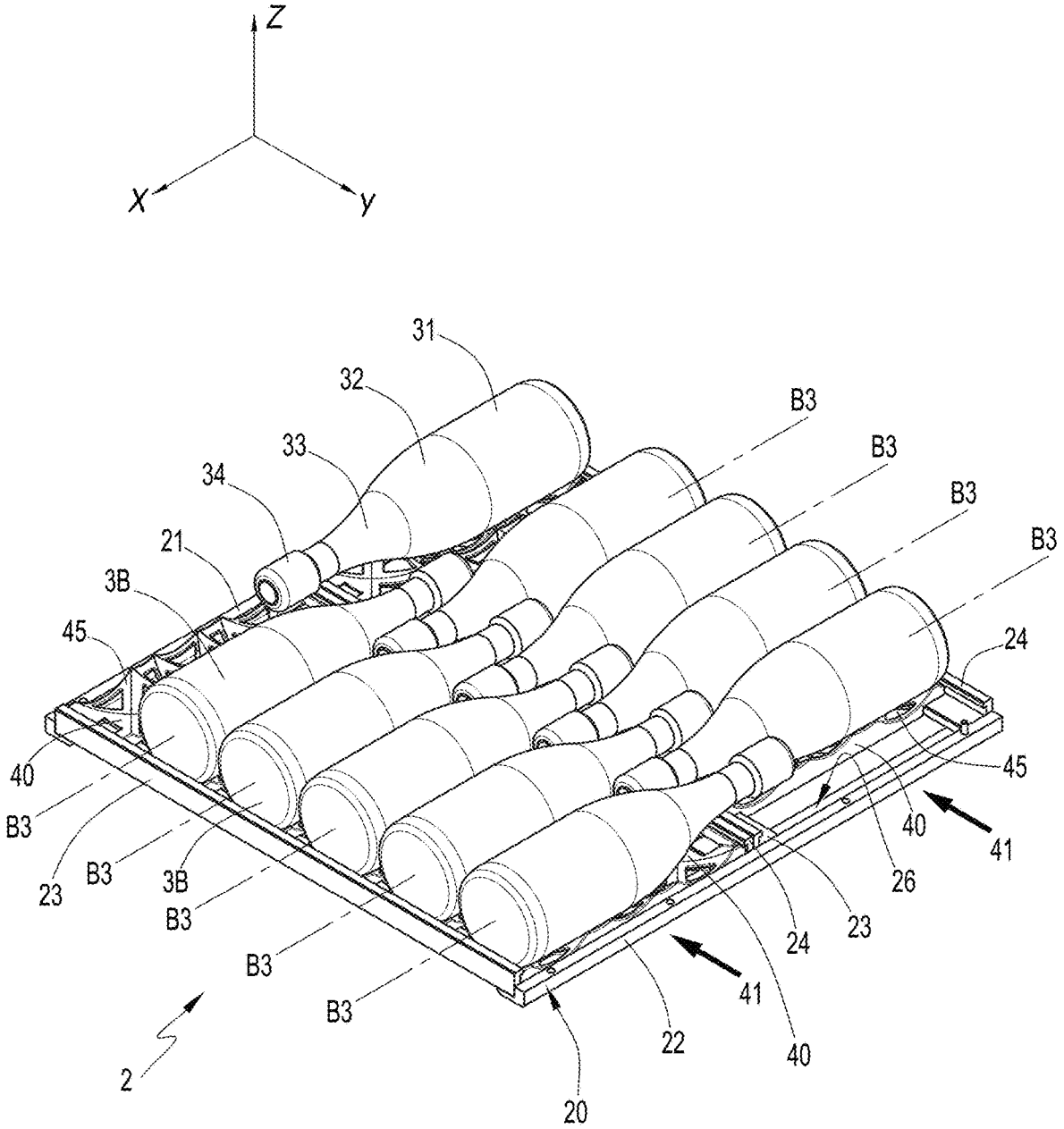
FIG. 3 is a view similar to the view of FIGS. 1 and 2, where the shelf is shown alone, accommodating bottles according to a third arrangement.

The cabinet 1 can accommodate bottles of different shapes. For example, FIGS. 1 and 2 show that bottles 3A have a first shape, e.g., Burgundy wine bottles. The bottles 3A are arranged on the shelf 2. For example, FIG. 3 shows that the bottles 3B have a second shape distinct from the shape of the bottles 3A. The bottles 3B are, e.g., bottles of champagne, arranged on the shelf 2, shown outside the cabinet 1. The shape of the bottles 3A differs from the shape of the bottles 3B, e.g. concerning a diameter of the body 31, the diameter of which is smaller for the bottles 3A than for the bottles 3B and, e.g., concerning a height of the bottle, measured from a base of the body 31 to an opposite end formed by the throat 34, the height being smaller for the bottles 3A than for the bottles 3B. Bottles of shapes other than the shapes of the present example may be placed on the shelf 2, the shelf 2 being apt to accommodate bottles having shapes different from each other.

Figure 4:
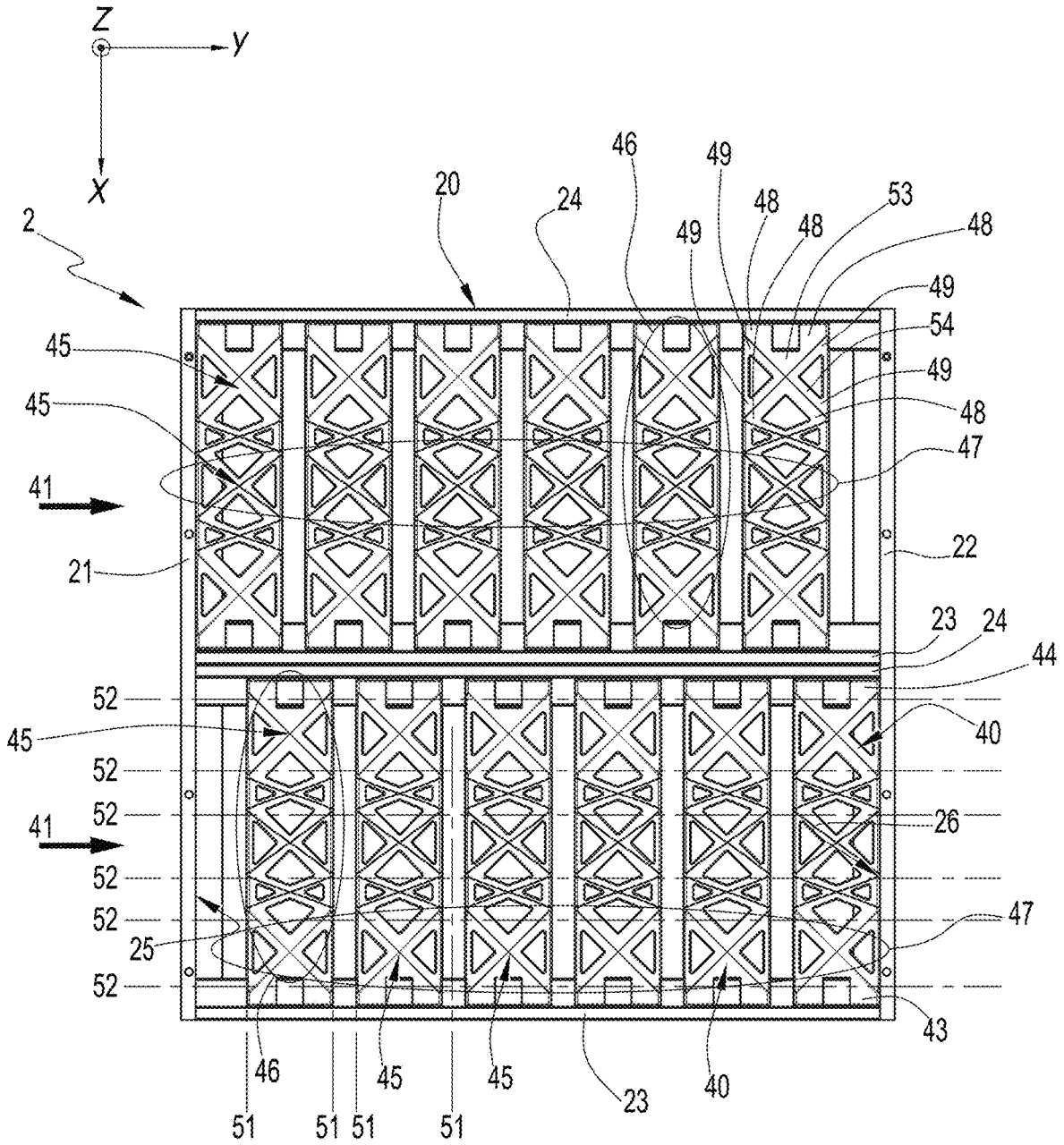
FIG. 4 is a top view of the shelf of the preceding figures, where supports are positioned according to a first configuration.
Figure 5:
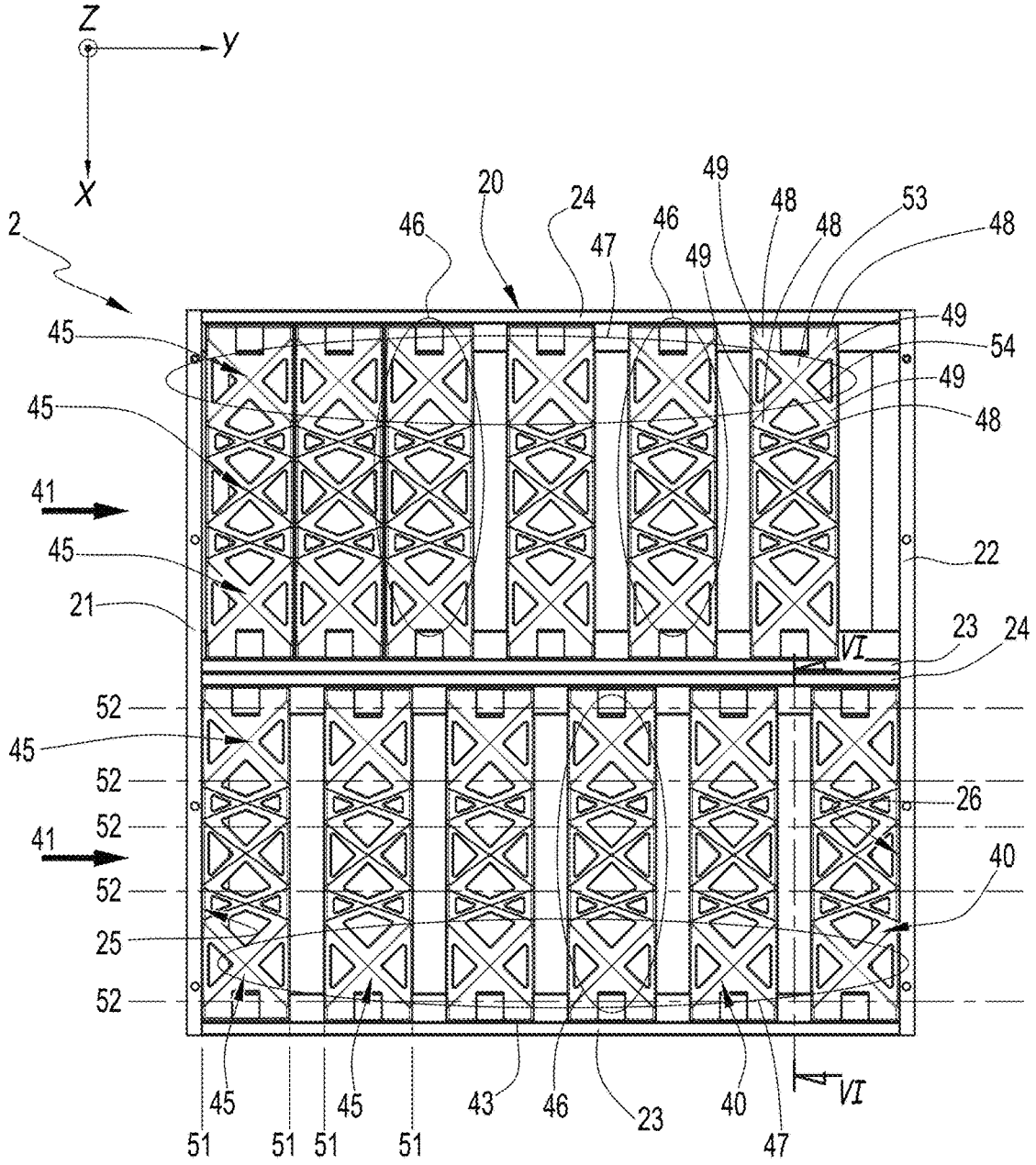
FIG. 5 is a view similar to the view of FIG. 4, where the supports are positioned according to a second configuration.

As can be seen more clearly in FIGS. 4 and 5, the shelf 2 comprises a frame 20 and at least one row 41 of supports 40. The frame 20 serves to support the supports 40. The supports 40 serve to support the bottles 3A and/or 3B.

Overall, the frame 20 is perpendicular to the direction Z. The directions X and Y are parallel to the frame 20. The directions X, Y and Z are defined as fixed with respect to the frame 20. The frame 20 advantageously comprises two side rails 21 and 22. The side rails 21 and 22 are parallel to the direction X and are arranged in the same plane perpendicular to the direction Z. The side rail 22 is offset along the direction Y with respect to the side rail 21. In order for the shelf 2 to be supported by the enclosure 11, the side rail 21 is supported by the wall 12 and the side rail 22 is supported by the wall 13. Preferably, it is via the side rails 21 and 22 that the shelf 2 slides with respect to the enclosure 11. For example, a first slide 28 is provided, fastened to the wall 12, which accommodates the side rail 21 by sliding, and a second slide, fastened to the wall 13, which accommodates the side rail 22 by sliding along the direction X. The second slide is not visible in the figures but is similar to the first slide 28.

The frame 20 advantageously comprises rails distributed in pairs, each pair comprising a first rail 23 and a second rail 24. As many pairs of rails 23 and 24 are provided as there are rows 41 of supports 40. Preferably, a minimum of two rails is provided, i.e., only one pair when there is a single row 41. The present example provides four rails, i.e., two pairs, since there are two rows 41 of supports 40. For each pair, the rail 23 is arranged along the direction X with respect to the rail 24.

Each rail 23 and 24 is parallel to the transverse direction Y and connects the side rails 21 and 22. The rails 23 and 24 are advantageously arranged in the same plane perpendicular to the direction Z.

The side rails 21 and 22 and the rails 23 and 24 are fixed relative to each other, being attached to each other at the intersections thereof.

Preferably, the supports 40 are identical with respect to each other. In the present example, each row 41 consists of six supports 40. However, it is possible to provide a number of supports 40 different from six for each row 41, at least two supports 40 for the same row 41.

The supports 40 belong to the same row 41 in that the supports 40 are distributed successively along the direction Y, being arranged side by side. In other words, for each row 41, the supports 40 are aligned along the direction Y, i.e., same are distributed along a row parallel to the direction Y, regardless of the sliding position of the supports 40. For each row 41, the supports 40 are arranged, along the direction Y, between the side rails 21 and 22 and, along the direction X, between the rail 23 and the rail 24 of the pair of rails associated with said row, regardless of the sliding position of the supports 40.

For each row 41, the supports 40 are supported by the frame 20 by means of the rails 23 and 24 assigned to the row 41. Each support 40 slides with respect to the frame 20 parallel to the direction Y. Preferably, each support 40 comprises a sliding end 43 and a sliding end 44, which are opposite each other, being aligned along the longitudinal direction X. The end 43 is arranged in the longitudinal direction X with respect to the end 44. For each support 40, the end 43 and the rail 23 associated with the row 41 concerned cooperate mechanically to guide a sliding of the support 40 relative to the frame 20, along the transverse direction Y. For each support 40, the end 44 and the rail 24 associated with the row 41 concerned cooperate mechanically to guide the sliding of the support 40 relative to the frame 20, along the transverse direction Y, in addition to the guiding performed by the end 43 and the rail 23. The support 40 thus connects the rail 23 to the rail 24 by being attached thereto by the ends 43 and 44. By means of the ends 43 and 44 and the rails 23 and 24, each support 40 slides along the direction Y, with respect to the frame 20.

Figure 6:
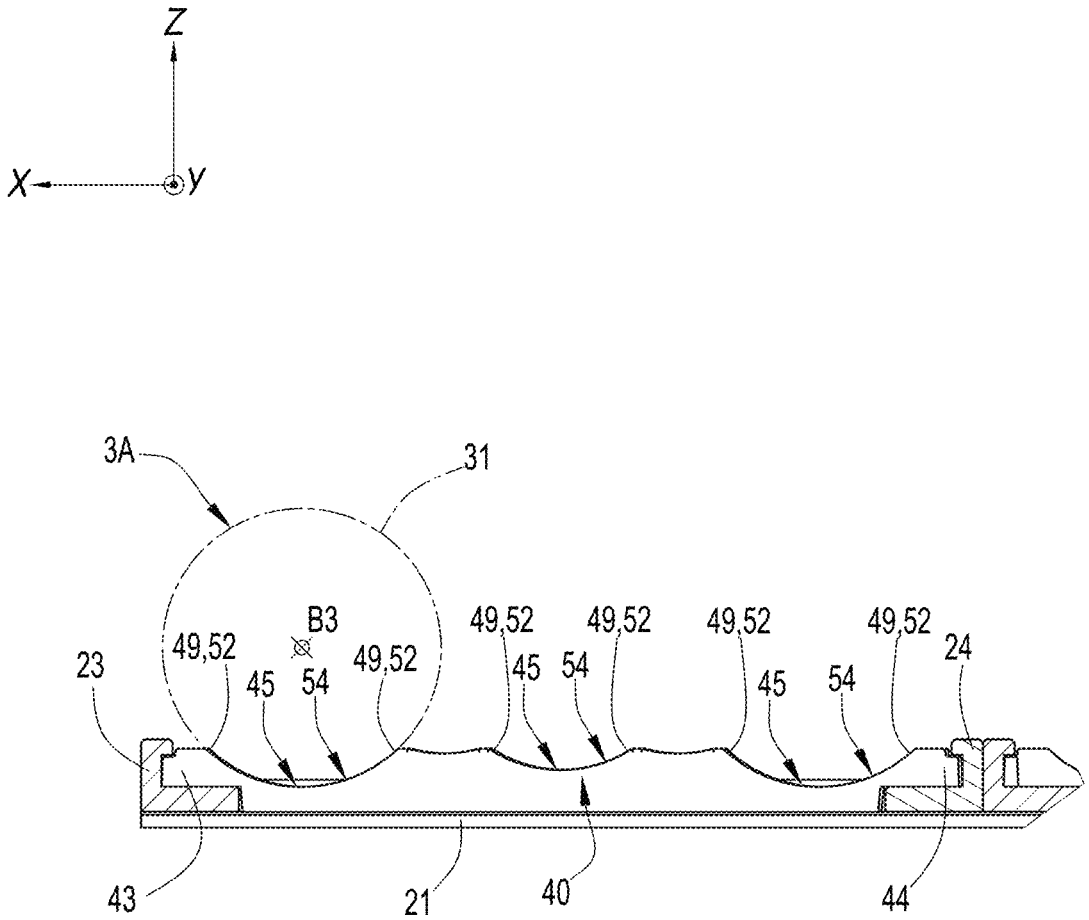
FIG. 6 is a partial sectional view of FIG. 5, along the cut line VI-VI.

For example, as shown in FIG. 6, it is possible to provide the rail 23 to have a hollow shape, open toward the support 40, to accommodate the end 43. It can be provided that the rail 24 has a hollow shape, open toward the support 40, to accommodate the end 44. In a variant, it could be provided that the ends 43 and 44 have a hollow shape to accommodate the rails 23 and 24. In any event, it is preferentially provided that, within the clearance, the mechanical cooperation between the rails 23 and 24 and the ends 43 and 44 prevents a movement of the support 40 parallel to the direction X, in both directions, and prevents a movement of the support 40 parallel to the direction Z, in both directions, prevents any rotation of the support 40, and permits a movement of the support 40 exclusively along the direction Y, in both directions.

For each row 41, for each support 40 which is arranged immediately between two other supports 40 of the same row 41, the movement of said support 40 along the direction Y, i.e., the sliding, is limited by said two other supports 40.

For each row 41, the side rail 21 advantageously forms a transverse stop 25, which connects the rails 23 and 24 to one another, and the side rail 22 advantageously forms a transverse stop 26, which connects the rails 23 and 24 to one another. For each row 41, all the supports 40 are arranged between the transverse stops 25 and 26, along the transverse direction Y. The stops 25 and 26 limit the sliding of the supports 40 of the row 41 along the direction Y, in both directions. For each row 41, the support 40 which is closest to the rail 23 is limited in the movement thereof along the direction Y by the transverse stop 25 and the support 40 which is a neighbor thereto. For each row 41, the support 40 which is closest to the rail 24 is limited in the movement thereof along the direction Y by the transverse stop 26 and the support 40 which is a neighbor thereto.

Overall, each support 40 slides with respect to the frame 20 independently of the other supports 40, in particular the supports of the same row 41, the sliding of each support 40 being either limited by one of the transverse stops 25 or 26 and the neighbor support 40 belonging to the same row 41, or by two neighbor supports 40 belonging to the same row. For this purpose, in particular, each support 40 is not attached to the other supports 40. It is thus possible to move one of the supports 40 without moving the others. To this end, it is provided that the transverse stops 25 and 26 are spaced apart from each other by a length, measured along the direction Y, which exceeds the sum of the respective widths of the supports 40 of the same row 41, the respective width of each support 40 being measured along the direction Y.

Due to the fact that each support 40 slides with respect to the frame 20 and to the other supports 40 of the same row 41, a user can modify the arrangement of the supports 40 of the row 41 between the stops 25 and 26, by sliding each support 40 to a desired position for the support 40, along the direction Y. Modifying the arrangement of the supports 40 is thus carried out without having to separate the supports 40 from the frame 20, which is particularly convenient to use and prevents losing the supports 40.

Insofar as the rails 23 and 24 exclusively permit the sliding movement of the supports 40 along the direction Y and the stops 25 and 26 limit the sliding in both directions along the direction Y, the supports 40 are trapped in the frame 20, i.e. are non-removable, being captive both of the rails 23 and 24 and of the stops 25 and 26. It is understood that the supports 40 are trapped in the frame 20 in that the supports 40 cannot be separated from the frame 20 during the use of the shelf 2, regardless of whether or not bottles are arranged on the shelf 2. Thereof excludes in particular that the support 40 can be separated from the frame 20 without tools, in particular by snapping off the support 40 from the frame 20, in that the support 40 and the frame 20 are not mutually snapped on. Thereof does not exclude the possibility that the support 40 can be separated from the frame 20 under special conditions which do not fall within the scope of the conventional use of the shelf, e.g., for the maintenance or repair of the shelf 2. Such particular conditions include, e.g., a disassembly of a part of the frame 20, a deterioration of the frame 20, a destruction of the frame 20, a disassembly of a part of the support 40, a deterioration of the support 40 or a destruction of the support 40, which would be likely to permit the separation of the support 40 and of the frame 20 from each other.

Each support 40 comprises a plurality of cradles 45, herein three cradles 45. Preferably, each support 40 has the same number of cradles 45 as the other supports 40. A number of cradles 45 other than three may be provided each support 40. It is via the cradles 45 that the shelf 2 supports the bottles 3A or 3B. Each cradle 45 is thus formed on the surface of the support 40, being oriented along the direction Z, so that the bottle can be arranged bearing on one or a plurality of the cradles 45, in the opposite direction to the direction Z. The cradles 45 belonging to the supports 40 of the same row 41 are arranged in the same plane perpendicular to the direction Z.

Whatever the number of cradles 45, all the cradles 45 of the same support 40 are advantageously arranged between the ends 43 and 44, i.e., between the rails 23 and 24 guiding the support 40, along the direction X. It is provided that the cradles 45 and the ends 43 and 44 of the same support 40 are fixed relative to one another, being attached to one another and/or being formed by a single piece, as is the case in the example illustrated.

For each support 40, the cradles 45 are aligned parallel to the longitudinal direction X of the frame 20, thereby forming a column 46 of cradles 45, the column 46 being parallel to the direction X. Each support 40 thus comprises its own column 46 of cradles 45, parallel to the same longitudinal direction X, the columns 46 thus being parallel to each other. Preferably, for each support 40, the end 44, a first cradle 45, a following cradle 45, and so on, follow one another along the direction X, up to the last of the cradles 45 of the column, and the end 43. For each row 41, there are thus obtained as many columns 46 as there are supports 40, namely e.g., six columns 46.

For each row 41 of supports 40, each cradle 45 of one of the supports 40 is aligned with one of the respective cradles 45 of each other support 40 of the row 41, along the transverse direction Y, to thereby form a row 47 of cradles 45, parallel to the direction Y. For each row 41, the same number of rows 47 as the number of cradles 45 for each support 40 is thus obtained, i.e., in the present example, three rows 47, since each support 40 has three cradles 45. The rows 47 are parallel to each other and to the direction Y. The rows 47 are distributed along the direction X.

Finally, for each row 41 of supports 40, a grid of cradles 45 belonging to the supports 40 is obtained, said cradles 45 being distributed along columns 46, with as many columns 46 as there are supports 40, and along rows 47, with as many rows 47 as there are cradles 45 per support 40. The spacing between the columns 46 is adjustable, by sliding the supports 40 relative to each other. The spacing between rows 47 is fixed.

The cradles 45 are configured so that each bottle can be accommodated on the shelf 2, either in a position called the "longitudinal position", where the axis B3 of the bottle is parallel to the longitudinal direction X, or in another position called the "transverse position", where the axis B3 of the bottle is parallel to the transverse direction Y. In FIGS. 1 and 3, all the bottles 3A and 3B are arranged in a longitudinal position. In FIG. 2, two of the bottles 3A are in transverse position, while all the other bottles are in a longitudinal position. Arranging the bottles in a longitudinal position generally makes it possible to place a large number of bottles on the shelf 2. However, it may be advantageous to arrange all or part of the bottles in a transverse position, in particular when the bottles have an atypical geometry or size and/or to highlight the bottles, since a label of the bottle, generally affixed to the body 31, can then be made visible from the front opening or through the glass door.

In order to arrange the bottle in a longitudinal position, same is placed on only one of the supports 40, by resting the body 31 of the bottle on at least one of the cradles 45, or even a plurality of cradles 45 belonging to the same column 46. In other words, each support 40 is apt to individually support one of the bottles, while the bottle is in the longitudinal position, with said bottle arranged on the column 46 of cradles 45 of the support 40. Said bottle is then oriented parallel to the direction X, in particular the axis B3 thereof. The bottle is then centered on the cradles 45, i.e., the axis B3 lies in a plane perpendicular to the direction Y which passes through the cradles 45 at the center thereof.

In order to arrange the bottle in a transverse position, same is placed at the same time on a plurality of supports 40 belonging to the same row 41, by resting the body 31 of the bottle on at least one of the cradles 45, or even a plurality cradles 45 belonging to the same row 47. In other words, the supports 40 of the same row 41 are configured to collectively support one of the bottles, while the bottle is in the transverse position, with said bottle placed on one of the rows 47 of cradles 45 defined collectively by the supports 40. Said bottle is then oriented parallel to the direction Y, in particular the axis B3 thereof. The bottle is then centered on the cradles 45, i.e., the axis B3 lies in a plane perpendicular to the direction X which passes through the cradles 45 at the center thereof.

Since the supports 40 of the row 41 slide with respect to one another and with respect to the frame 20, the user can adapt the arrangement of the supports 40 of the row 41 along the direction Y so that a plurality of bottles can be placed side by side in a longitudinal position, each bottle being placed on one of the supports 40. In particular, the supports 40 can be moved apart from one another so that one or a plurality of bottles can be placed thereon, the body 31 of which has a large diameter, side by side in the longitudinal position. In particular, the supports 40 can be brought closer together to place one or a plurality of bottles thereon, the body 31 of which has a smaller diameter, side by side in the longitudinal position. When all the bottles to be arranged side by side on the row 41 having a body 31 of similar diameter, it is possible to choose to position the supports 40 evenly distributed along the direction Y. As shown, e.g., in FIGS. 1, 3 and 4, it is possible to choose to arrange the supports 40 of the first row 41 offset with respect to the supports 40 of the second row 41, which makes it possible to arrange the bottles in a longitudinal position side by side on the two rows 41, the bottles of the first row 41 having the throat 34 thereof oriented toward the second row 41 and the bottles the second row 41 having the throat 34 thereof oriented toward the first row 41, the throats 34 of the bottles of the first row 41 being accommodated between the throats 34 of the bottles of the second row 41. Thereof is particularly advantageous for storing a large number of bottles even if the bottles have a significant height. In particular, it is possible to distribute the supports 40 evenly along the direction Y, by positioning the supports 40 of a first of the rows 41 offset with respect to the supports 40 of the second row 41, as shown in FIGS. 1 and 4, e.g., when the bodies 31 have the same diameter and the bottles have a high, height. According to another example, it is possible to distribute the supports 40 of the first of the rows 41 regularly along the direction Y, and of the second row 41 irregularly along the direction Y, i.e., with supports 40 grouped together and other supports more spaced apart from each other, as shown in FIG. 5. As a result, the shelf 2 can be adapted to the geometry and to the arrangement of the bottles. As shown in FIG. 2, some bottles may be arranged in a transverse position whereas the others are in a longitudinal position.

All such examples show that the shelf 2 is particularly versatile and gives complete freedom in the arrangement of the bottles.

Each cradle 45 has a particular structure, described hereinafter, which enables same to accommodate the bottle, as desired, in a longitudinal arrangement and in a transverse position.

Figure 7:
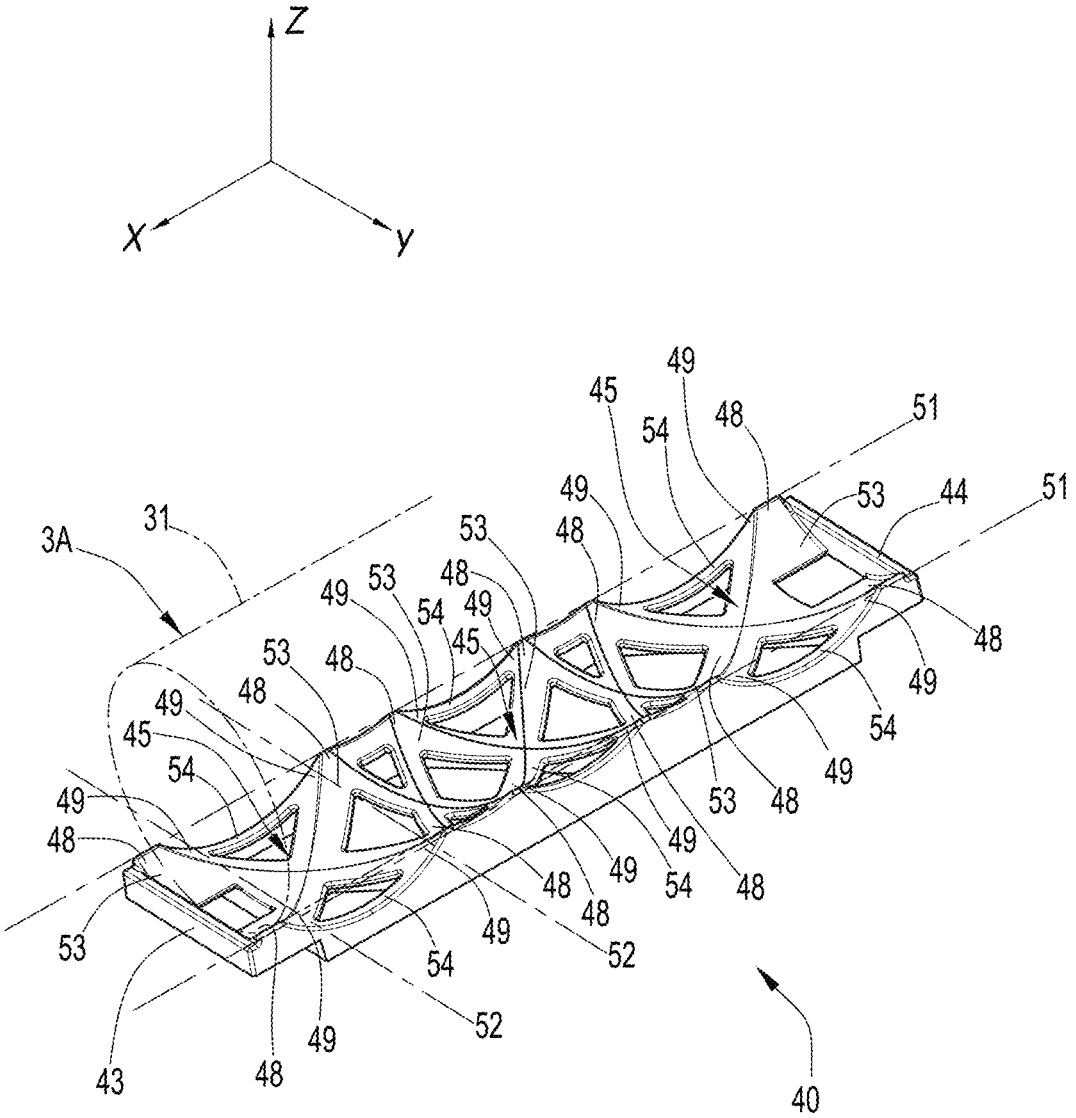
FIG. 7 is a perspective view of one of the supports shown in the preceding figures, sown alone.

Preferably, as can be seen more clearly in FIG. 7, each cradle 45 comprises two pairs of transverse wedges 48 and two pairs of longitudinal wedges 49. However, a different number of wedges 48 and 49 may be chosen, with at least one pair of transverse wedges 48 and one pair of longitudinal wedges 49 for each cradle 45.

As shown in FIGS. 4 and 7, for each column 46 of cradles 45, the transverse wedges 48 are distributed in exactly two columns 51 of transverse wedges 48, spaced apart from each other and parallel to the longitudinal direction X. For each pair of wedges 48, one of the wedges 48 belongs to one of the columns 51 whereas the other wedge 48 belongs to the other column 51. Preferably, for each pair of wedges 48, the two wedges 48 are aligned along the transverse direction Y. As a result, for each cradle 45, the wedges 48 are arranged in a square or a rectangle.

As an example, the body 31 of a bottle 3A is shown diagrammatically in broken lines in FIG. 7, with the bottle 3A in a longitudinal position on the support 40. As shown in FIG. 7, the two columns 51 of transverse wedges 48 are configured to accommodate the bottle 3A therebetween, when the bottle 3A is arranged on the column 46 of cradles 45 in the longitudinal orientation. More precisely, each pair of wedges 48 accommodates the bottle 3A between said wedges 48. In the case where the body 31 of the bottle has a sufficiently large diameter, the wedges 48 belonging to a plurality of pairs of wedges 48 can come into contact with the body 31 of the bottle, on both sides of the bottle, to prevent the bottle from rolling along the direction Y. In the case where the body 31 of the bottle has a smaller diameter, the wedges 48 belonging to a plurality of pairs of wedges 48 can remain distant from the body 31 of the bottle. However, since the spacers 48 are arranged on both sides of the bottle, the wedges 48 prevent the bottle from rolling along the direction Y out of the cradles 45 which accommodate same. In all cases, the bottle 3A is stably accommodated on the column 46 of cradles 45, even if there are no other bottles adjacent to the bottle on the shelf 2.

As shown in FIGS. 4 and 7, for each row 47 of cradles 45, the longitudinal wedges 49 are distributed along exactly two rows 52 of longitudinal wedges 49, spaced apart from each other and parallel to the transverse direction Y. For each pair of wedges 49, one of the wedges 49 belongs to one of the rows 52 whereas the other wedge 49 belongs to the other row 52. Preferably, for each pair of wedges 49, the two wedges 49 are aligned along the longitudinal direction X. It results therefrom that, for each cradle 45, the wedges 49 are arranged in a square or a rectangle.

As an example, the body 31 of a bottle 3A is shown diagrammatically in broken lines in FIG. 6. The bottle 3A is arranged in a transverse position on a plurality of supports 40 of the same row 41, even if a single support 40 is visible in FIG. 6. As shown in FIG. 6, the two rows 52 of longitudinal wedges 49 are configured to accommodate the bottle 3A therebetween when the bottle 3A is arranged on the row 47 of cradles 45 in the transverse orientation. More precisely, each pair of wedges 49 accommodates the bottle 3A between said wedges 49. If the diameter of the body 31 of the bottle is sufficiently large, wedges 49 belonging to a plurality of pairs of wedges 49 can come into contact with the body 31 of the bottle 3A, on both sides of the bottle 3A, to prevent the bottle from rolling along the longitudinal direction X. If the diameter of the body is smaller, the body 31 is arranged between the wedges 49 of a plurality of pairs, without necessarily being in contact with the wedges on both sides of the bottle. In such situation, the wedges 49 nevertheless prevent the bottle from rolling along the direction X out of the cradles 45 which accommodate same. In all cases, the bottle 3A is stably accommodated on the row 47 of cradles 45, even if there are no other bottles adjacent to the bottle on the shelf 2.

As can be seen more clearly in FIGS. 6 and 7, each cradle 45 advantageously comprises two longitudinal cylindrical surfaces 53 and two transverse cylindrical surfaces 54, which aim to further improve the stability of the bottle when same is accommodated on the cradles 45, in the longitudinal position and in the transverse position, respectively. "Cylindrical surface" means that the surface has the geometry of a portion of a cylinder with a circular base. In other words, same is a recessed rounded surface, the rounded profile of which is a portion of a cylinder.

The longitudinal cylindrical surfaces 53 of the same support 40 are all coaxial with the same longitudinal axis, parallel to the longitudinal direction X. It should be thereby understood that it is the portion of the cylinder described by the surface 53 which is centered on the longitudinal axis. Each cylindrical surface 53 connects two of the transverse wedges 48 of the same pair of wedges 48 belonging to the same cradle 45. Each cylindrical surface 53 is hollow at the surface of the cradle 45, between the two wedges 48, to accommodate the bottle 3A and prevent same from rolling along the direction Y, while the bottle 3A is placed in the longitudinal position on the support 40. Depending on the diameter of the body 31 of the bottle 3A, the surfaces 53 match the body 31 of the bottle 3A to a variable extent. When the bottle 3A is placed on the cradles 45 in a longitudinal position, the cylindrical surfaces 53 tend to center the bottle on the cradles 45 by gravity, along the direction Y.

The transverse cylindrical surfaces 54 of the same cradle 45 are coaxial with the same transverse axis, parallel to the transverse direction Y. It should be thereby understood that it is the portion of the cylinder described by the surface 54 which is centered on the transverse axis. The transverse cylindrical surfaces 54 belonging to the cradles 45 of the same row 47 are coaxial with the same transverse axis, parallel to the transverse direction Y. Each cylindrical surface 54 connects two of the longitudinal wedges 49 of the same pair of wedges 49 belonging to the same cradle 45. Each cylindrical surface 54 is hollow at the surface of the cradle 45, between the two wedges 49, to accommodate the bottle 3A and prevent same from rolling along the direction X, while the bottle 3A is placed in the transverse position on the support 40. Depending on the diameter of the body 31 of the bottle 3A, the surfaces 54 match the body 31 of the bottle 3A to a variable extent. When the bottle 3A is arranged on the cradles 45 in a transverse position, the cylindrical surfaces 54 tend to center the bottle on the cradles 45 by gravity, along the direction X.

For each cradle 45, the two transverse cylindrical surfaces 54 are separated by the two longitudinal cylindrical surfaces 53 and the two longitudinal cylindrical surfaces 53 are separated by the two transverse cylindrical surfaces 54. Consequently, the cradle 45 advantageously has the general shape of a cross.

Any feature described for one of the embodiments or one of the variants hereinabove, is applicable to the other embodiments and variants described hereinabove, as far as is technically feasible.

The invention claimed is:

1. A shelf for a cabinet for accommodating bottles, the shelf comprising:

a frame comprising a first rail and a second rail which are parallel to a transverse direction, each rail having a hollow shape; and at least one row of supports, which are supported by said frame, which are aligned along a transverse direction parallel to said frame, each support comprising:

a first sliding end accommodated in the hollow shape of said first rail;

a second sliding end, opposite said first sliding end along a longitudinal direction, accommodated in the hollow shape of said second rail; and cradles, the cradles of a same support being aligned parallel to the longitudinal direction parallel to said frame, to form a column of cradles, and each cradle of one of the supports being aligned with one of the cradles of the other supports along the transverse direction to form a row of cradles, wherein (i) each support is slidable relative to said frame parallel to the transverse direction, in that each first sliding end is guided by said first rail during sliding, and each second sliding end is guided by said second rail during sliding, (ii) each support is configured to individually support a bottle in a longitudinal position, where the bottle is arranged on the column of cradles of the support while being oriented parallel to the longitudinal direction, the column of cradles forming transverse wedges between which the bottle, in the longitudinal position, is accommodated, to prevent the bottle from rolling out of the column of cradles, along the transverse direction, and (iii) the supports are configured to collectively support the bottle in a transverse position, where the bottle is arranged on one of the rows of cradles of the supports, being oriented parallel to the transverse direction, the row of cradles forming longitudinal wedges between which the bottle, in the transverse position, is accommodated, to prevent the bottle from rolling out of the row of cradles, along the longitudinal direction.

2. The shelf according to claim 1, wherein, for each column of said cradles, the transverse wedges are distributed in two columns spaced apart and parallel to the longitudinal direction, the two columns being configured to accommodate the bottle therebetween when the bottle is arranged on the column of cradles in the longitudinal position.

3. The shelf according to claim 1, wherein, for each row of said cradles, the longitudinal wedges are distributed along two rows spaced apart and parallel to the transverse direction, the two rows of longitudinal wedges being configured to accommodate the bottle therebetween when the bottle is arranged on the row of cradles in the transverse position.

4. The shelf according to claim 1, wherein each cradle comprises:

two longitudinal cylindrical surfaces, each longitudinal cylindrical surface connecting two of the transverse wedges of the cradle and being configured to accommodate the bottle while the bottle is in the longitudinal position; and two transverse cylindrical surfaces, each transverse cylindrical surface connecting two of the longitudinal wedges of the cradle and being configured to accommodate the bottle while the bottle is in the transverse position, the two transverse cylindrical surfaces being separated by said two longitudinal cylindrical surfaces and said two longitudinal cylindrical surfaces being separated by the two transverse cylindrical surfaces.

5. The shelf according to claim 1, wherein each support is non-removably attached to said frame.

6. The shelf according to claim 1, wherein said frame comprises:

a first transverse stop which connects said first rail to said second rail; and a second transverse stop which connects said first rail to said second rail, the supports being arranged between said first transverse stop and the second transverse stop parallel to the transverse direction, so that said first transverse stop and the second transverse stop limit the sliding of the supports with respect to the frame, wherein the supports are trapped in said frame, being captive to said first rail, said second rail, said first transverse stop and said second transverse stop.

7. The shelf according to claim 1, wherein two rows of supports are provided.

8. The shelf according to claim 1, wherein for each support at least three cradles are provided.

9. A cabinet, comprising:

the shelf according to claim 1, the frame of the shelf comprising a first side rail and a second side rail between which the at least one row of supports of the shelf is arranged, the first side rail and the second side rail being parallel to the longitudinal direction; and an enclosure, comprising a first side wall and a second side wall between which said shelf is arranged, said shelf being supported by the enclosure, in that the first side wall supports said first side rail and in that the second side wall supports said second side rail.

* * * * *